US006494387B1

(12) United States Patent
Kaneko

(10) Patent No.: US 6,494,387 B1
(45) Date of Patent: Dec. 17, 2002

(54) LOW-PRESSURE ATOMIZING SPRAY GUN

(75) Inventor: Masaru Kaneko, Fujisawa (JP)

(73) Assignee: Anest Iwata Corporation, Kanagawa-ken (JP)

( * ) Notice: Subject to any disclaimer, the term of this patent is extended or adjusted under 35 U.S.C. 154(b) by 0 days.

(21) Appl. No.: 09/763,729

(22) PCT Filed: Jun. 30, 1999

(86) PCT No.: PCT/JP99/03508

§ 371 (c)(1),
(2), (4) Date: Feb. 27, 2001

(87) PCT Pub. No.: WO01/02099

PCT Pub. Date: Jan. 11, 2001

(51) Int. Cl.[7] ..... B05B 1/28
(52) U.S. Cl. ..... 239/296; 239/300
(58) Field of Search ..... 239/296, 297, 239/300

(56) References Cited

FOREIGN PATENT DOCUMENTS

| | | |
|---|---|---|
| JP | 58-202061 | 11/1983 |
| JP | 63-5791 | 2/1988 |
| JP | 8-196950 | 8/1996 |

*Primary Examiner*—Lesley D. Morris
(74) *Attorney, Agent, or Firm*—Wenderoth, Lind & Ponack, L.L.P.

(57) ABSTRACT

Disclose is a low-pressure atomizing spray gun. The spray gun comprises an air spray gun body, a paint nozzle attached to the spray gun body, an air cap attached to the air spray gun body to cover the paint nozzle, and air groove on a tip portion of the paint nozzle. An annular slit is defined between a central opening of the air cap and the paint nozzle. The air grooves extend from at or upstream of an inlet end of the annular slit towards a discharge end of the nozzle. Also, a discharge end of the paint nozzle projects from 0.3 mm to 0.8 mm from a front end of the central opening in the air caps.

22 Claims, 9 Drawing Sheets

LOW-PRESSURE ATOMIZING SPRAY GUN

TECHNICAL FIELD

The present invention relates to a spray gun for atomization of paint under a spraying air pressure of 0.07 MPa or less, and more particularly to a low-pressure air spray gun having an improved atomization mechanism used in a non-premixing type air spray gun in which compressed air and paint are mixed outside a spray head, and which is capable of providing a spray pattern which assures an improved atomization of the paint.

BACKGROUND ART

Non-mixing type air spray guns are widely used in the field of general industrial paint coating. They are defined as "spray gun" in the Japanese Industrial Standard (JIS) as well. According to the definition in JIS, the non-premixing type air spray gun is one adapted to jet compressed air from an annular slit defined between a paint nozzle and air cap and around the paint nozzle at a velocity greater than the speed of sound under a specified spraying air pressure of 0.24 to 0.34 MPa, and thus atomize and spray the paint to an object surface, thereby forming a paint coating on the object surface. This paint coating method has great applicability not depending upon any shape of an object surface to be coated and type of a paint used. However, the coating method is not advantageous in that much atomized paint is easily airborne or scattered and overspray causes a large loss of the paint. Because of the possible environment and air pollution by the airborne atomized paint with the conventional air spray guns, there has been a growing trend over the world to impose limitations on conditions of using the air spray gun.

To accommodate such a trend, various measures have been proposed heretofore. Accordingly, much attention has been focused on a low-pressure spray gun using spraying air pressure limited to less than 0.07 MPa for minimizing the airborne atomized paint and enabling an improved efficiency of paint coating to an object surface.

The low-pressure spray guns include some types based on different principles. One of the principles is to limit the spraying air pressure to less than the standard atmosphere to prevent paint particles from getting airborne or being scattered. With this spray gun, however, the limited spraying air pressure will lead to a reduced air speed, with the result that the paint atomization based on the difference in speed between gas and liquid flows, will be extremely poor. To compensate for the insufficiency of paint atomization, a low-pressure spray gun has been proposed in which the width of an air jet slit formed between a paint nozzle and air cap is increased to atomize the paint with a correspondingly increased amount of air. The mechanism of this low-pressure spray gun is basically the same as that of the conventional high-pressure spray guns. Namely, the air jet slit formed around the paint nozzle is designed wider to provide a larger amount of air jet even under a low pressure.

The poor atomization of the paint due to the reduced spraying air pressure involves some problems which cannot be solved just by increasing the air amount. Namely, it has been pointed out, as such problems, that when the amount of paint flow is increased, the central portion of the paint flow will not sufficiently mix the flow of air, resulting in an incomplete mixing, so that the paint flow in the center of the spray pattern cannot sufficiently be atomized, which is likely to take place with a paint having a slightly higher viscosity, and thus coarse paint particles will fly around the spray pattern when the width of an elliptical spray pattern is adjusted. That is, the;reduction of the spraying air pressure will lead to a non-uniform atomization of the paint.

To solve the above problems, the Applicant of the present invention has proposed to form a plurality of v-shaped air grooves in the tip of the paint nozzle as disclosed in his Japanese Patent Application No. 7-25907 (Japanese unexamined Patent Publication No. 8-196950). However, this method was found practically not satisfactory and involves some problems to be solved.

According to the invention disclosed in the above Japanese Patent Application, compressed air will flow into a flow of paint still in the paint nozzle, thereby improving the efficiency of paint atomization. However, since paint and air flows will prematurely be mixed in the paint nozzle or just before the tip of the paint nozzle, the paint spray will be limited, resulting in a lower efficiency of the paint coating.

That is, when a paint flow from the delivery portion of a paint nozzle is supplied under pressure, the amount of paint spray will depend upon the pressure applied to the paint flow, independently of the pressure and amount of the compressed air jet supplied from the aforementioned annular slit. However, in a gravity or suction type spray gun in which the paint spraying depends upon the attraction by the compressed air jet supplied from the annular slit, the condition of jetting the compressed air to the paint delivery port will not only seriously influence the atomization but also the amount of paint spray; that is, the efficiency of coating and optimization of the spray gun itself.

SUMMARY OF THE INVENTION

To atomize a paint under a low pressure and prevent occurrence of coarse particles in parts of a paint spray and non-uniform paint atomization, the present invention has an object to overcome the above-mentioned drawbacks of the prior art by providing a practically high efficiency spray gun.

More particularly, the present invention has a primary object to overcome the drawbacks, of the low-pressure atomization mechanism used in the conventional non-premixing type air spray gun, that atomization of paint is partially insufficient due to a low pressure of air flow, by providing a low-pressure atomizing spray gun including an atomization mechanism for a non-premixing type air spray gun, adapted to effectively mix low-pressure air jets supplied from an annular slit defined between the tip of a paint nozzle and a central opening in an air cap when the latter is fixed on the paint nozzle, with a paint flow from the paint nozzle and uniformly atomize the central portion of the paint flow. Accordingly, provided is a uniform spray pattern without reduction in the amount of the paint spray due to the attraction by the air jet supplied.

The present invention has another object to overcome the drawbacks of the prior art, that the sprayed paint particles easily adhere to the surface of the air cap depending upon a position where the mixed flow is diffused, the air cap surface has to be cleaned periodically, and it is necessary to prevent a paint coating once formed from being spoiled by the paint particles re-flying from the air cap surface.

According to a first aspect of the present invention, there is provided a low-pressure atomizing spray gun including an air spray gun body, a paint nozzle screwed to the spray gun body, and an air cap installed with a cover thereof to the spray gun body to cover the paint nozzle. The paint nozzle and air cap corporate with each other to mix, in the atmosphere, compressed air and a paint flow just delivered from the paint nozzle and to atomize the paint. The spray gun includes a plurality of air grooves formed in the tip of the paint nozzle convergently towards the center of the delivery port of the paint nozzle. And, each of the air grooves begins at or upstream of the inlet end of a central opening in the air cap.

In the above spray gun, the inner end is the starting point at which the air flow through a central annular slit will substantially form an axial flow. The air grooves are formed such that the cross section of each groove increases towards the paint nozzle delivery port end, and the plurality of air grooves extends toward the center of the delivery port end while converging at an angle of 45 to 90 degrees to the inside diameter from the outside diameter. Thus, owing to the air jets supplied from the plurality of air grooves, the compressed air is mixed with the paint flow deep to the center of the latter, thereby permitting the paint to be completely and uniformly atomized.

Also, according to a second aspect of the present invention, there is provided a low-pressure atomizing spray gun of a suction or gravity type including an air spray gun body, a paint nozzle screwed to the spray gun body, an air cap installed with a cover thereof to the spray gun body to cover the paint nozzle. The paint nozzle and air cap work cooperatively with each other to mix, in the atmosphere, compressed air and a paint just delivered from the nozzle to atomize the paint, wherein an annular-slit is defined between the tip portion of the paint nozzle and the wall of a central hole formed in the air cap. A plurality of air grooves is formed on the tip portion of the paint nozzle convergently at an angle of 45 to 90 degrees from the circumference of the nozzle tip towards the wall of a delivery hole in the nozzle to the inside diameter of the nozzle. The intersection of the bottom of a v-shaped air groove with the inside diameter of the paint nozzle approximately coincides with the front end of the central opening in the air cap, and the front end of the paint nozzle tip projects 0.3 to 0.8 mm from the front end of the central opening in the air cap.

With the above construction, the atomized paint flow is controlled against any further flying, the amount of paint spray is prevented from being reduced-under the action of the air inflow from the air grooves to limit the air jets, and the paint is prevented from adhering to the air cap, thereby assuring a stable spraying of the paint. The relatively thick air flow jet from the annular slit defined around the paint nozzle assures uniform atomization of the paint. Thus, the low-pressure atomizing spray gun according to the present invention can effectively atomize the paint as with a high pressure air spray gun.

The addition of the atomization mechanism of the present invention to the paint atomization mechanism of the conventional low-pressure air spray gun, which is based only on the increase of the central air flow, defines a positional relationship between the paint nozzle and air cap, which assures atomization of the paint with a highly improved efficiency and a reduced amount of air.

These and other objects, features and advantages of the present invention will become more apparent from the ensuing detailed description of the preferred embodiments of the present invention when taken in conjunction with the accompanying drawings.

DESCRIPTION OF THE PREFERRED EMBODIMENTS

Figure 1:
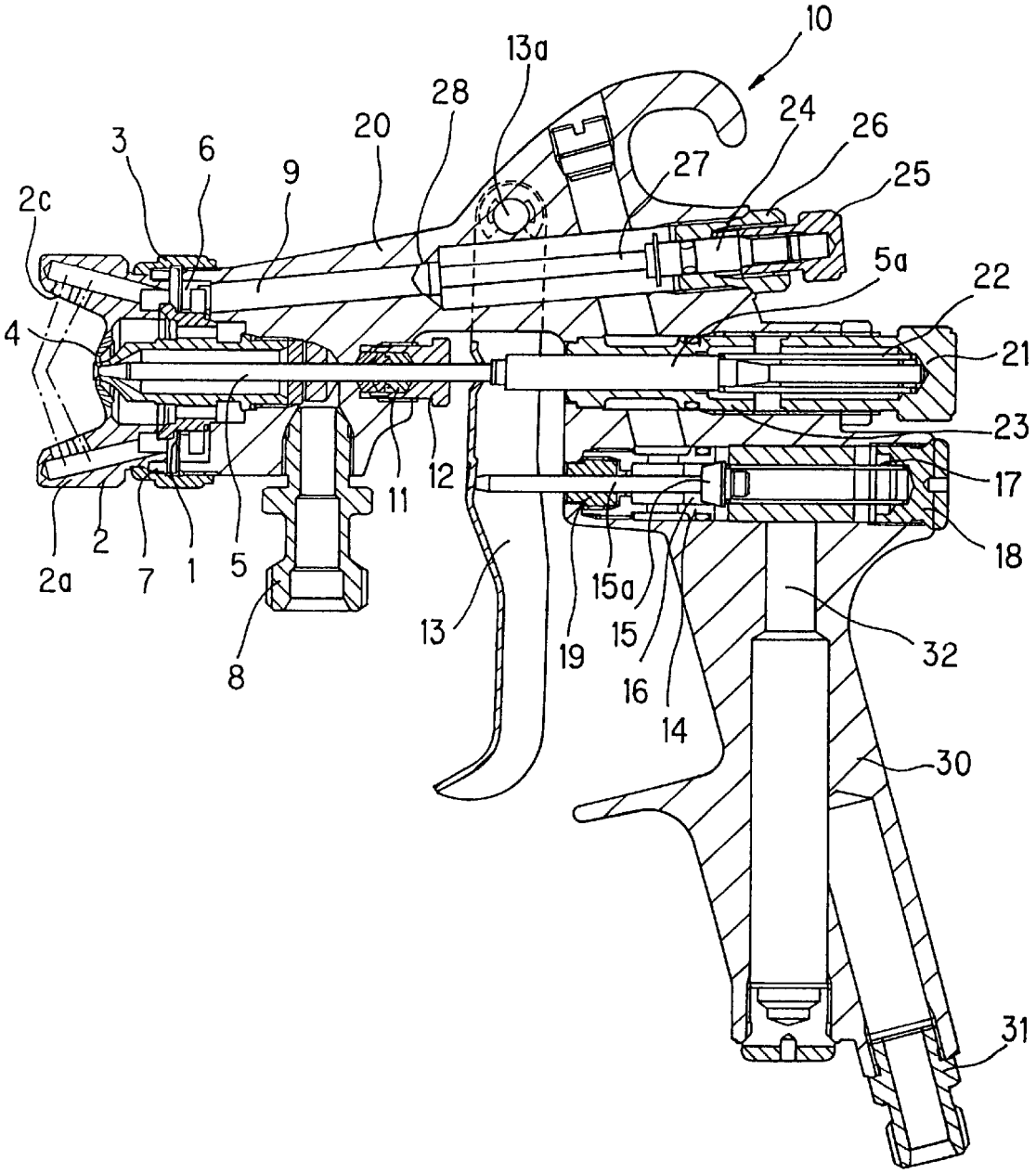
Fig. 1 PRIOR ART
FIG. 1 is a sectional view of a conventional low-pressure atomizing spray gun as a whole.

Referring now to FIG. 1, there is schematically illustrated the construction of a conventional low-pressure atomizing spray gun which will be illustrated and described by way of example herein for the better understanding of the present invention.

The body of the spray gun is generally indicated with a reference numeral 10. As shown, the spray gun body 10 includes a barrel 20 and grip 30. An air inlet fitting 31 is provided in the lower portion of the grip 30. The air inlet fitting communicates with an air passage 32. The air inlet fitting 31 is to be connected to a compressed air source. Compressed air supplied from the source through the air inlet fitting 31 is fed to the tip of the spray gun body 10 through an air valve cavity 16 provided above the air passage 32. The air valve cavity 16 includes an air valve seat 14, air valve 15 and packing set 19. The air valve cavity 16 also has a coil spring 17 by which the air valve 15 is pressed to the air valve seat 14 of the air valve cavity 16, whereby the air valve is sealed. There is also provided a cap screw 18 to adjust and set the coil spring 17 and air valve 15. The air valve 15 has a rod 15*a* extending to a trigger 13. When the trigger 13 is pulled, a needle valve guide 5*a* is slid back to pull a needle valve 5, and the air valve 15 is opened slightly earlier than the needle valve 5 thus pulled so that the compressed air will be fed slightly earlier than the paint is delivered from a paint nozzle 1.

There are provided on a rearward extension line of the center of the paint nozzle 1 screwed to the barrel 20, the needle valve guide 5*a* to pull the needle valve 5 linearly, and also a guide chamber 23 to guide the needle valve guide 5*a*. Compressed air is fed around the guide chamber 23. The needle valve 5 is pressed by a coil spring 22, provided behind the needle valve guide 5*a*, to the inner surface of a seat in a delivery port of the paint nozzle 1, whereby the needle valve 5 is sealed. The coil spring 22 is retained by a paint delivery control knob 21. As the paint delivery control knob 21 is rotated, a guide rod provided behind the needle valve guide 5*a* abuts the paint delivery control knob 21 to limit the sliding stroke of the needle valve 5, that is, the clearance between the seat of delivery port 100 of the paint nozzle 1 and the needle valve 5, whereby the paint delivery can be controlled.

Also, there is provided above the paint delivery control knob 21 of the barrel 20 a pattern divergence adjuster 24 to shunt the compressed air to the center and front end 2*a* of an air cap 2, and adjust the amount of air supplied to front end 2*a*. The pattern divergence adjuster 24 is rotated along with a pattern divergence adjusting valve 27 and pattern divergence control knob 25 to a pattern divergence adjustment guide 26. By turning the pattern divergence control knob 25, the amount of compressed air supplied to lateral air holes 2*c* in the front end 2*a* of the air cap 2, which is screwed with an air cap cover 3 to the barrel 20, is adjusted in accordance with the clearance between the pattern divergence adjusting valve 27 and a valve seat 28 provided in the air passage, and thus the divergence of a sector-like spray pattern is adjusted.

A passage (not shown) of the compressed air fed from the air passage 32 formed the grip 30 is formed parallel to and alongside an air passage 9 provided in the seat 28 of the pattern divergence adjusting valve 27. Therefore, the air passage is branched out at the seat 28 into two, of which one supplies the air to the center of the air cap 2 while the other supplies the air to the front end 2*a*. There is no control in the passage for the air supplied to the center of the air cap 2, and so an air pressure from the air passage 32 will be supplied as it is to the center of the air cap 2.

In the above spray gun, when the trigger 13 is pulled about a trigger pivot 13*a* like a pendulum, the air valve 15, and then the needle valve 5, is pulled. On the other hand, paint is supplied to the paint nozzle 1 from a paint source (container or hose; not illustrated) connected to a paint joint 8. There is provided a needle valve packing 11 to provide a sealing against paint leak from the seat of the delivery port of the paint nozzle 1 and needle valve 5 behind the paint nozzle 1. The needle valve packing 11 is retained by a packing adjusting screw 12. In case of a suction or gravity type spray gun adapted to suck and spray paint with the attraction by the compressed air jet from the central opening of the air cap, the needle valve packing 11 functions also to prevent the compressed air from entering the paint passage. The packing adjusting screw 12 is rotated with an appropriate tightness to tighten the needle valve packing 11, to prevent paint leakage or suction of outside air, and for the needle valve 5 to be able to smoothly work.

Figure 2:
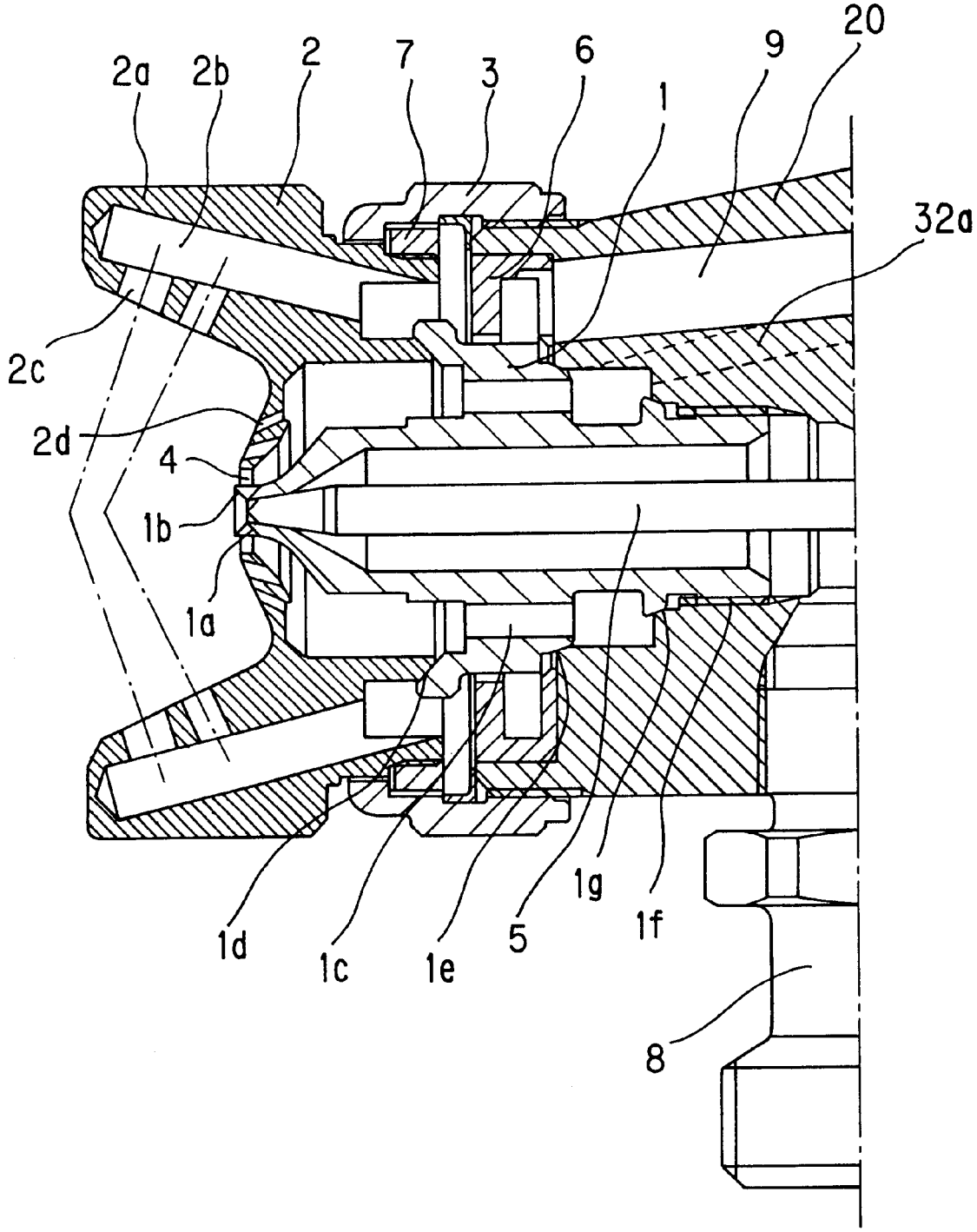
FIG. 2 is a sectional view, enlarged in scale, of the front end portion of the low-pressure atomizing spray gun according to the present invention.

Referring now to FIG. 2, there is illustrated in the form of a sectional view, enlarged in scale, the front end portion of the low-pressure spray gun according to the present invention. In FIG. 2, the same or similar elements as in FIG. 1 will be indicated with the same or similar reference numerals as in FIG. 1.

As shown, the paint nozzle 1 is screwed with a paint nozzle screw 1*f* to the barrel 20 of the spray gun body 10, and lower tapers 1*e* and 1*g* are connected to each other so that supply of paint from the paint joint 8 is shut off and supply of the compressed air to annular slit 4 and front end 2*a* is also shut off.

The air cap 2 is installed to the barrel 20 with the air cap cover 3, under which a cover ring 7 is placed, to thereby cover the paint nozzle 1. An upper taper 1*d* is provided to shut off supply of the compressed air to the center and front end of the air cap as with the lower taper 1*e*. The inside of the paint nozzle 1 is sealed since an inner taper of the paint nozzle 1 is pressed by an end taper of the needle valve 5.

The compressed air under a low pressure, shunted inside the barrel 20 and supplied through the air passage 9, is passed via a lateral air passage 2*b* in the front end 2*a* of the air cap 2 through a collar 6 and jetted out of symmetrically formed lateral air holes 2*c* to form an elliptical spray pattern. One or more lateral air holes 2*c* is provided at each of symmetrical positions in the front end of the air cap 2. By adjusting the amount of the air jet supplied from the lateral air holes 2*c* by means of the pattern divergence adjuster 24, the sector-like divergence of the spray pattern is adjusted.

The other air flow shunted inside the barrel 20 is passed from the air passage 32*a* to the center of the air cap 2 through a central air hole 1*c* formed in the paint nozzle 1. There are provided in the center of the air cap 2 the annular slit 4 defined between the front end circumference of the paint nozzle 1 and the central portion of the air cap 2, and auxiliary air holes 2*d* crossing the extension line of the air jet supplied from the lateral air holes 2*c*. The auxiliary air holes 2*d* are destined to balance the spray pattern correspondingly to the force of the air jet supplied from the lateral air holes 2*c*. One or more such holes 2*c* is provided.

Figure 3A:
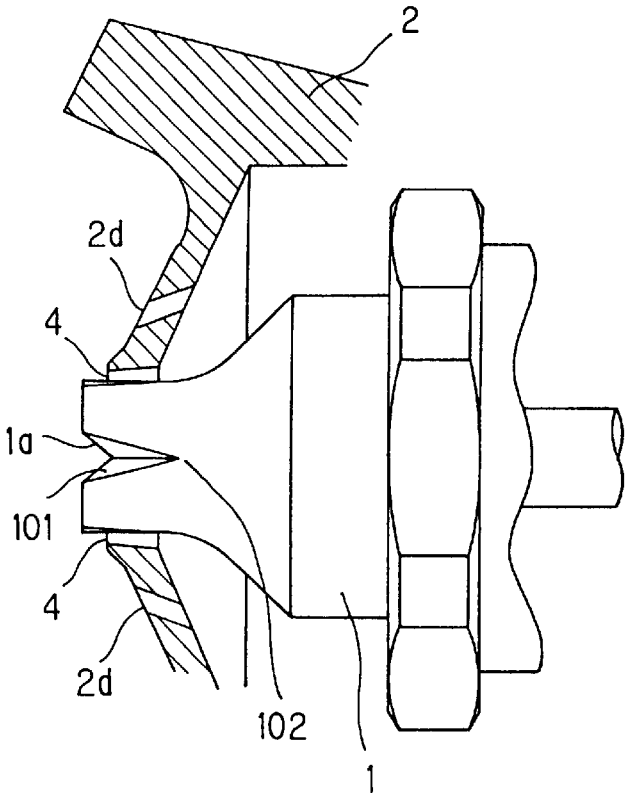
FIG. 3A is an explanatory drawing, enlarged in scale, of the paint nozzle tip and air cap.
Figure 3B:
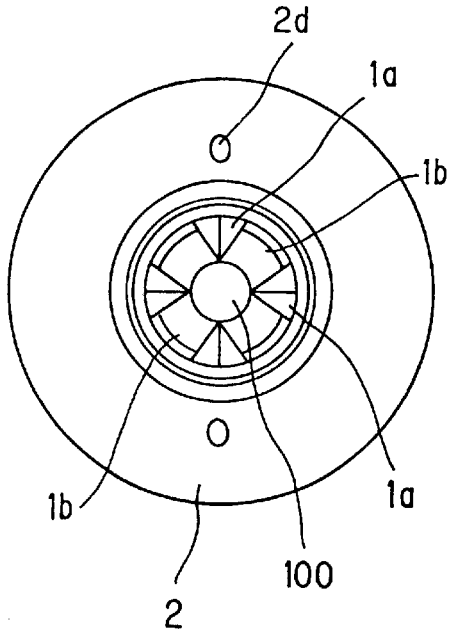
FIG. 3B is a projection view of the paint nozzle tip and air cap from the delivery port.

The tip of the paint nozzle 1 is located in the central opening of the air cap 2 to define the annular slit 4, and the plurality of air grooves 1*a* formed in the tip of the paint nozzle 1 supplies radial air flows to the annular slit 4. As shown in FIGS. 3 to 5, the air grooves 1*a* are formed convergent from the outside diameter of the tip of the paint nozzle 1 towards the center of the delivery port 100 of the paint nozzle 1, and the bottom of each air groove 1*a* is at the inside diameter of the paint nozzle 1. The angle of the convergence is within a range of 45 to 90 degrees, whereby the air flows coming into the air grooves 1*a* collide with the paint flow from the paint nozzle so that even a low-pressure air flow can mix with the paint flow deep to the central of the latter, thus providing a complete atomization of the paint.

Note that the number of the air grooves 1*a* is not limited, but when the difference (thickness) between the outside and inside diameters of the paint nozzle 1 is 0.5 to 2 times that of the inside diameter, four air grooves 1*a* should suitably be provided. Normally, to form a spray pattern, the compressed air jets from both sides are directed towards the center of the central spray flow to spread the spray perpendicularly to the compressed air. To balance the air flow, the air grooves should preferably be provided at 6 to 8 places.

Each of the plurality of air grooves 1*a* is formed from a v-shaped groove 101 starting at a point 102 which is inside an inlet end 201 of a central opening 200 of the air cap 2. See FIGS. 4A and 4B. Normally, the inlet end 201 of the central opening 200 of the air cap 2 adjoins a large angle-tapered surface 202 of the air cap 2. The junction of the inlet end 201 and taper surface 202 is rounded in some cases. In such a case, the compressed air flows into the central opening 200 substantially at the inlet end 201. Therefore, when the compressed air supplied into the air cap 2 flows into the central opening 200, portions thereof passing through the air grooves 1*a* will flow through the inlet opening 201 and through the slit 4, and thus effectively collide with the paint flow while increasing the area of gas-liquid contact.

Divergently tapered guide walls 1*b* are provided at positions other than the intersection of the air grooves 1*a* and inside diameter of the delivery port 100 of the paint nozzle tip. The angle of the divergence of the guide walls 1*b* is about 90 degrees. The guide wall 1*b* extends from the delivery hole 100 to near the outside diameter of the paint nozzle tip to guide the paint flow at the same angle for a divergently wide spreading. Thus, the paint flow will crossingly collide with the air flow jet supplied from the annular slit 4.

Further, the starting points 102 of the plurality of air grooves 1*a* are positioned at or upstream of the inlet end 201 of the central opening 200 of the air cap 2, so that the compressed air under a relatively low pressure can cut into the paint flow deep to the center of the latter and disperse the paint, thereby assuring an improved atomization of the paint. Also, since the air grooves 1*a* extend to the inside diameter of the delivery hole 100 of the paint nozzle 1, and the guide walls 1*b* extend divergently in a conical form forwardly from the other end of the delivery hole 100, the paint flows colliding with each other, and thus dispersed inside the delivery hole 100 of the paint nozzle 1, can be prevented from being diffused more than necessary and hence the paint flow can positively collide with the compressed air jet supplied from the annular slit 4 and be atomized with a higher efficiency.

Figure 4A:
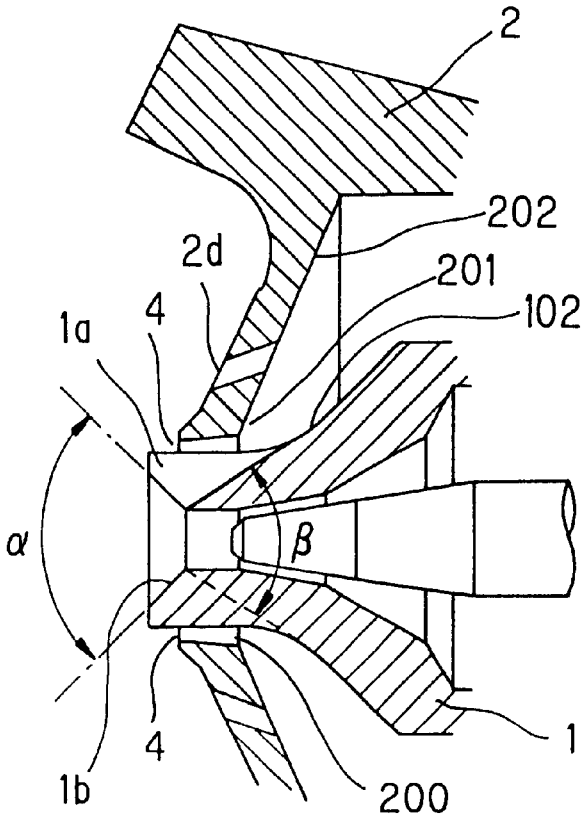
FIG. 4A is a sectional view, enlarged in scale, of the paint nozzle tip and air cap.
Figure 4B:
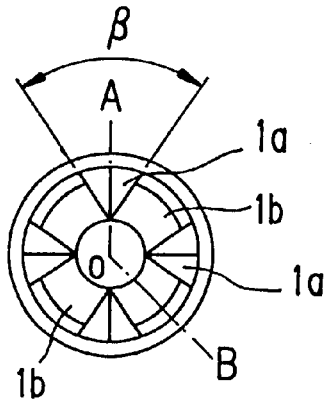
FIG. 4B is a projection view of the paint nozzle front end portion and air cap from the delivery port.
Figure 5:
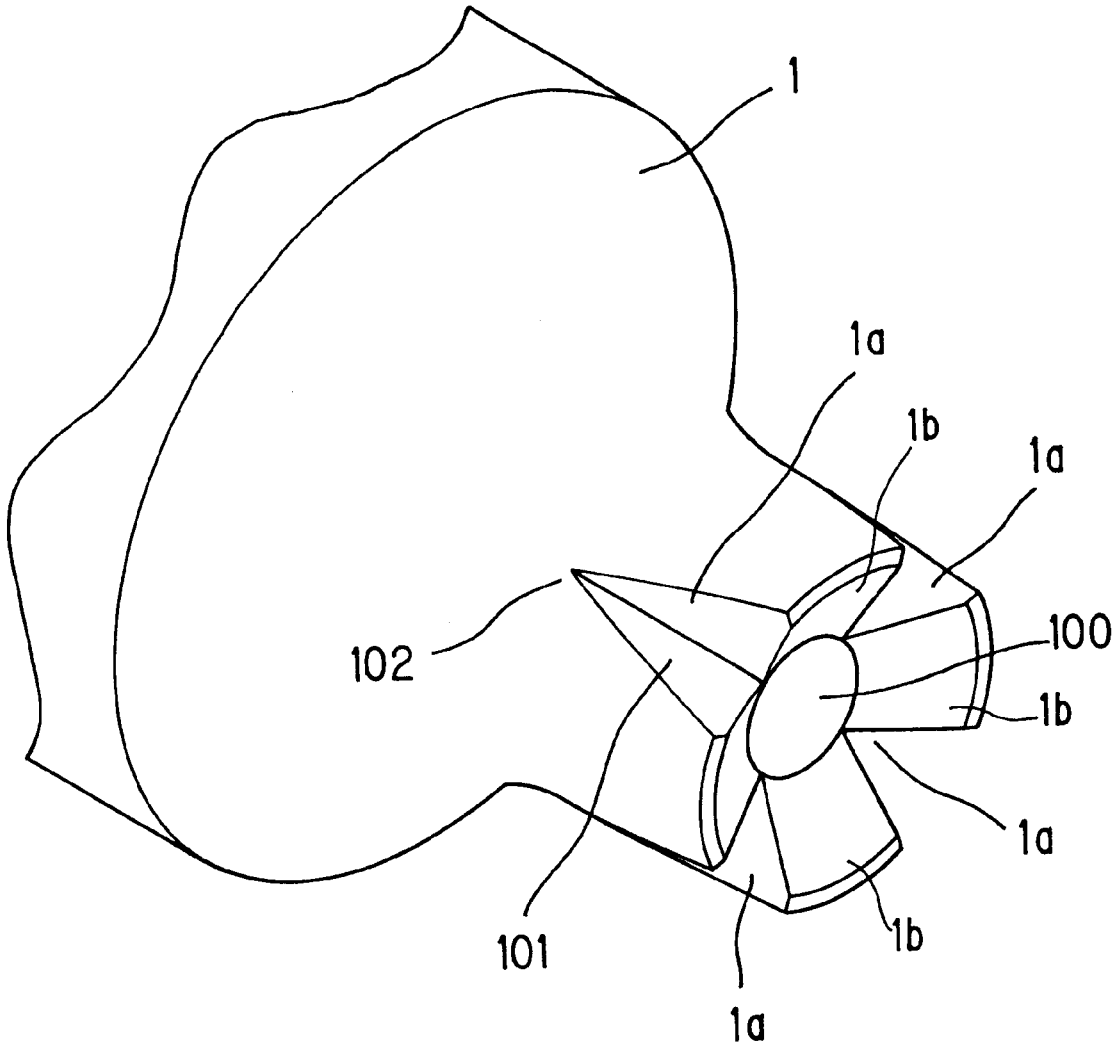
FIG. 5 is a perspective view of the air grooves in the paint nozzle tip.
Figure 6:
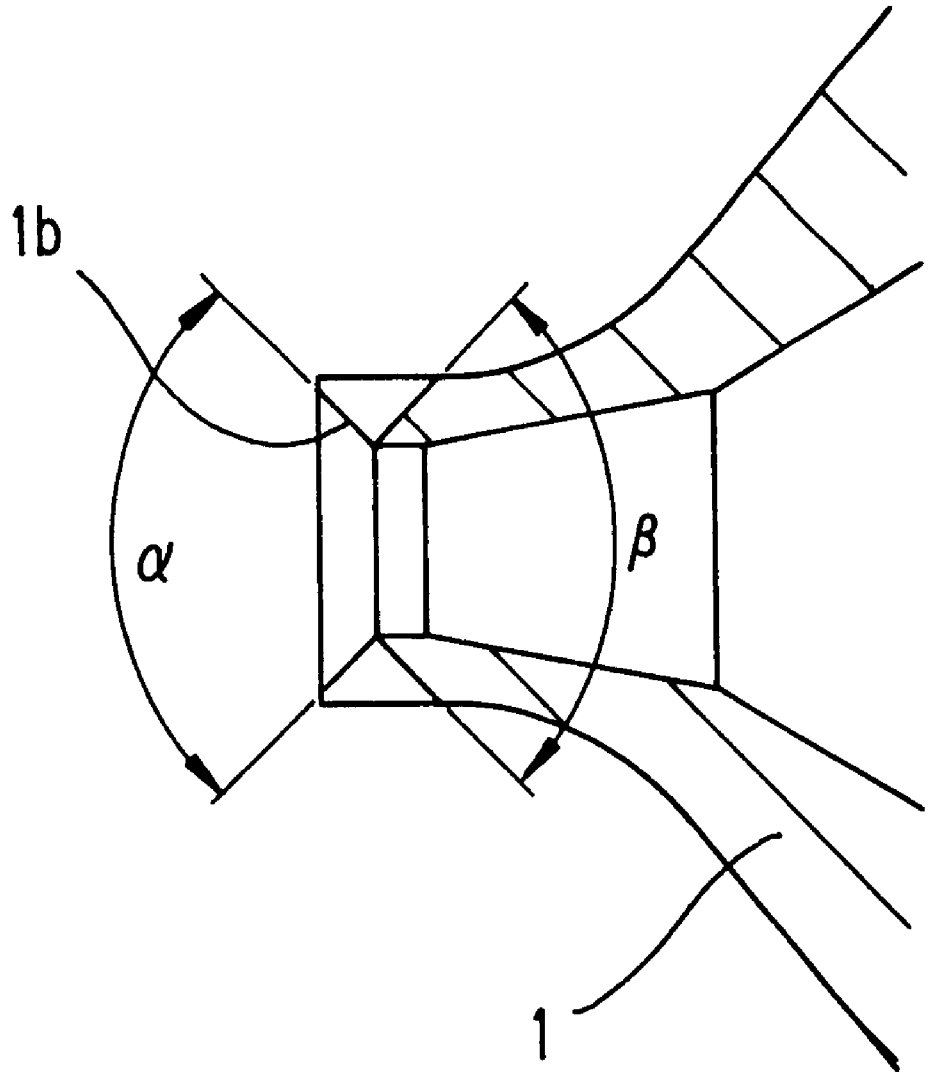
FIG. 6 is an explanatory drawing, enlarged in scale, of the paint nozzle tip.

FIG. 4A is an explanatory drawing, enlarged in scale, of the paint nozzle front end portion, and FIG. 4B is a projection view of the paint nozzle front end portion from the delivery port. FIG. 4A is a sectional view taken along the line A-O-B in FIG. 4B. FIG. 6 is an explanatory drawing, enlarged in scale, of the tip of the paint nozzle 1. AS shown, the air grooves 1*a* each being v-shaped and opened at an angle β of more than 45 degrees are formed to extend toward the center of the paint nozzle 1. The divergent angle β of the v-shaped groove is shown to be 90 degrees; however, the present invention is not so limited. The reason why the air groove 1*a* is a V-shaped is that the paint flow has to be split by the air flow directed to the center of the paint flow. The radius of curvature of the groove bottom should be smaller than the inside diameter of the delivery hole 100 of the paint nozzle 1, and preferably be smaller than a half of the inside diameter.

The conical guide walls 1*b* are provided at the front end of the air grooves 1*a*. Each guide wall 1*b* is divergent at an angle α. As shown, this angle of the guide walls 1*b* is within 90 degrees since the guide walls 1*b* extend in a cylindrical form from the delivery hole 100 of the paint nozzle 1. Namely, the divergent conical spreading of the guide walls 1*b* makes more effective the paint atomization by the crossing collision of the paint flow with the compressed air jetted forwardly.

Owing to the aforementioned construction, the compressed air will mix with the paint flow deep to the center of the latter and the paint will be dispersed. The thus dispersed and diverged flow of paint particles is controlled by the guide walls 1*b* in the flowing direction of the paint flow, and the compressed air flow layer supplied from the annular slit 4 around the paint nozzle 1, and having a relatively large thickness, will atomize the paint flow uniformly deep to the center of the latter. Thus, the paint will be atomized with a uniform distribution of the paint particles and a high efficiency.

Furthermore, by projecting the paint nozzle 1 more forward, it is possible to prevent the paint from adhering to the air cap 2, and thus assure a stable spraying of the paint.

Figure 7:
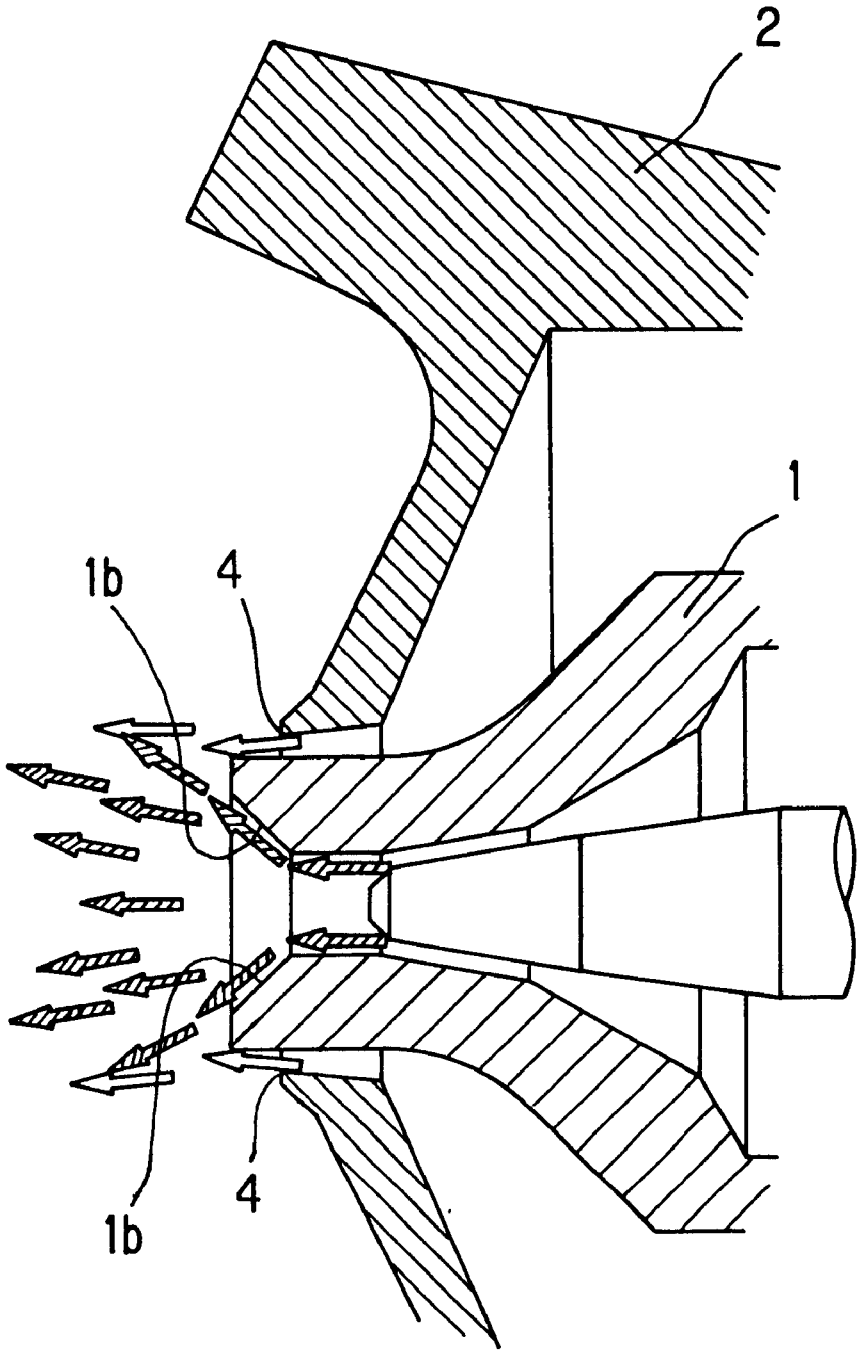
FIG. 7 is a sectional view of the paint nozzle tip and air cap when paint and air flows crossingly collide with each other and the paint is atomized.
Figure 8:
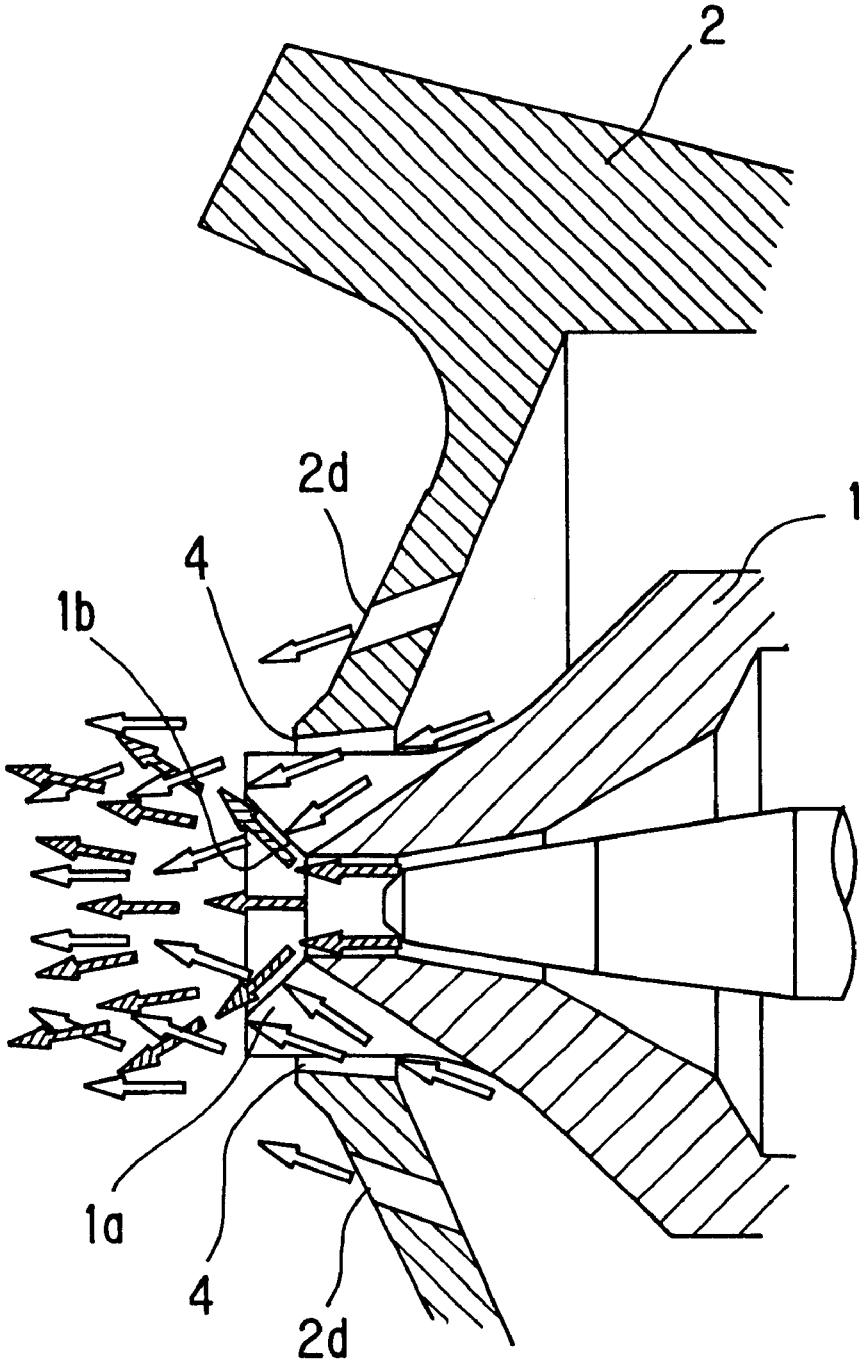
FIG. 8 is also a sectional view of the paint nozzle tip and air cap when paint and air flows crossingly collide with each other and the paint is atomized.
Figure 9:
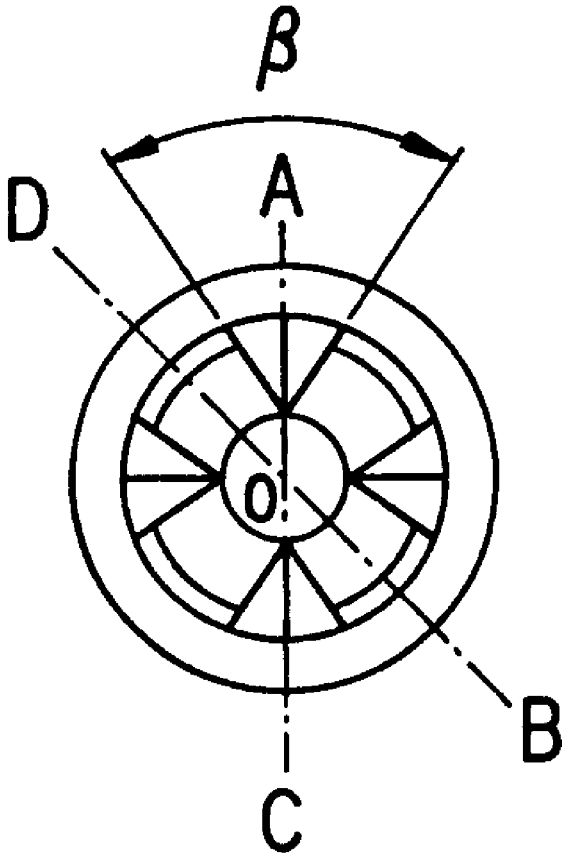
FIG. 9 is a projection view of the paint nozzle from the delivery port in FIGS. 7 and 8.

FIGS. 7 and 8 show the flows of paint from the paint nozzle 1 and the compressed air jet supplied from the annular slit 4, and FIG. 9 is a projection view of the paint nozzle from the delivery port 100 in the paint nozzle 1. FIG. 7 is a sectional view taken along the line D-O-B in FIG. 9, and FIG. 8 is a sectional view taken along the line A-O-C in FIG. 9. It should be noted that the white arrow indicates the air flow while the black arrow indicates the paint flow. As Will be seen from these drawings, both the air flow from the annular slit 4 and those from the air grooves 1*a* around the paint nozzle 1 will cut into the paint flow deep to the center of the latter and contribute to the paint atomization.

The air flows from the air grooves 1*a* (V-shaped) can effectively cut into the paint flow. However, such air grooves, if applied in the conventional gravity type or suction type spray gun will limit the delivery of the compressed air, leading to a reduced delivery of paint spray.

To assure a paint spray delivery of 100 to 200 ml/M, which will not influence the paint coating, the convergent angle β of the air grooves 1*a* should desirably be as small as possible within a range of about 45 to 90 degrees, and the geometrical relationship between the paint nozzle 1 and air cap 2 should also desirably be such that the tip of the paint nozzle 1 projects 0.3 to 0.8 mm from the central opening of the air cap 2. However, it should be noted that if the starting point of the V-shaped groove 101 of the air groove 1*a* is located beyond the central opening 200 of the air cap 2, the paint flow will not effectively be atomized. Namely, a smaller convergent angle β of the V-shaped groove 101 will provide a longer guiding by the groove, namely, a more effective delivery of compressed air, and will reduce the influence of the air grooves on the delivery of paint spray. Also, by projecting the tip of the paint nozzle 1 forward from the front end of the air cap 2, it is possible to effectively prevent the delivered paint particles from adhering to the air cap 2.

INDUSTRIAL APPLICABILITY

As having been described in the foregoing, the present invention provides a low-pressure atomization spray gun with which a paint flow under a pressure of less than 0.07 MPa can be atomized, paint mist can be prevented from being easily airborne, and the paint can be sprayed with an improved efficiency. Therefore, the spray gun according to the present invention can overcome the drawbacks such-as mist scattering and loss of the paint due to an overspray with the non-premixing type air spray gun, and will contribute very much to the improvement of the working environment and prevention of air pollution.

What is claimed is:

1. A low-pressure atomizing spray gun comprising:

an air spray gun body;

a paint nozzle attached to said spray gun body, said paint nozzle having a delivery port and a tip portion with a discharge end;

an air cap attached to said spray gun body to cover said paint nozzle, said air cap having an inner surface defining a central opening within which is positioned said tip portion of said paint nozzle such that an annular slit having an inlet end is defined between said inner surface of said air cap and said tip portion of said paint nozzle; and air grooves on said tip portion of said paint nozzle, said air grooves converging toward a center of said delivery port and extending from at or upstream of said inlet end of said annular slit toward said discharge end of said tip portion of said nozzle, and said air grooves each having a cross-sectional area that progressively increases toward said delivery port of said paint nozzle, with a bottom of each of said air grooves extending from an outer periphery of said paint nozzle to an inner periphery of said paint nozzle, such that said paint nozzle and air cap cooperate with each other to mix, in the atmosphere, compressed air and paint just delivered from said paint nozzle to atomize the paint.

2. The low-pressure atomizing spray gun according to claim 1, wherein said paint nozzle is attached to said spray gun body by being screwed to said spray gun body.

3. The low-pressure atomizing spray gun according to claim 2, wherein said air cap includes a cover.

4. The low-pressure atomizing spray gun according to claim 3, wherein said inlet end of said annular slit defines a starting point at which air flow through said annular slit substantially forms an axial flow.

5. The low-pressure atomizing spray gun according to claim 4, wherein each of said air grooves converges at an angle of from 45° to 90° and has a V-shaped cross section.

6. The low-pressure atomizing spray gun according to claim 5, further comprising forwardly diverging conical guide walls at an intersection of said bottom of said air grooves with said inner periphery of said paint nozzle.

7. The low-pressure atomizing spray gun according to claim 6, wherein said intersection of said bottom of said air grooves with said inner periphery of said paint nozzle approximately coincides with a front end of said central opening in said air cap, and said discharge end of said tip portion of said paint nozzle projects from 0.3 mm to 0.8 mm from said front end of said central opening in said air cap.

8. The low-pressure atomizing spray gun according to claim 3, wherein each of said air grooves converges at an angle of from 45° to 90° and has a V-shaped cross section.

9. The low-pressure atomizing spray gun according to claim 3, further comprising forwardly diverging conical guide walls at an intersection of said bottom of said air grooves with said inner periphery of said paint nozzle.

10. The low-pressure atomizing spray gun according to claim 1, wherein said inlet end of said annular slit defines a starting point at which air flow through said annular slit substantially forms an axial flow.

11. The low-pressure atomizing spray gun according to claim 1, wherein an intersection of said bottom of said air grooves with said inner periphery of said paint nozzle approximately coincides with a front end of said central opening in said air cap, and said discharge end of said tip portion of said paint nozzle projects from 0.3 mm to 0.8 mm from said front end of said central opening in said air cap.

12. The low-pressure atomizing spray gun according to claim 1, wherein each of said air grooves converges at an angle of from 45° to 90° and has a V-shaped cross section.

13. The low-pressure atomizing spray gun according to claim 1, further comprising forwardly diverging conical guide walls at an intersection of said bottom of said air grooves with said inner periphery of said paint nozzle.

14. The low-pressure atomizing spray gun according to claim 1, wherein said air cap includes a cover.

15. A low-pressure atomizing spray gun comprising:

an air spray gun body;

a paint nozzle attached to said spray gun body, said paint nozzle having a delivery port and a tip portion with a discharge end;

an air cap attached to said spray gun body to cover said paint nozzle, said air cap having an inner surface defining a central opening within which is positioned said tip portion of said paint nozzle such that an annular slit having an inlet end is defined between said inner surface of said air cap and said tip portion of said paint nozzle; and air grooves on said tip portion of said paint nozzle, said air grooves converging at an angle of from 45° to 90° from an outer periphery of said tip portion of said paint nozzle toward an inner periphery of said tip portion of said paint nozzle that defines said delivery port, wherein an intersection of a bottom of said air grooves with said inner periphery of said paint nozzle approximately coincides with a front end of said central opening in said air cap, and said discharge end of said tip portion of said paint nozzle projects from 0.3 mm to 0.8 mm from said front end of said central opening in said air cap, such that said paint nozzle and air cap cooperate with each other to mix, in the atmosphere, compressed air and paint just delivered from said paint nozzle to atomize the paint.

16. The low-pressure atomizing spray gun according to claim 15, wherein said paint nozzle is attached to said spray gun body by being screwed to said spray gun body.

17. The low-pressure atomizing spray gun according to claim 16, wherein said air cap includes a cover.

18. The low-pressure atomizing spray gun according to claim 17, further comprising forwardly diverging conical guide walls at said intersection of said bottom of said air grooves with said inner periphery of said tip portion of said paint nozzle.

19. The low-pressure atomizing spray gun according to claim 18, wherein said air grooves extend from at or upstream of said inlet end of said annular slit toward said discharge end of said tip portion of said nozzle.

20. The low-pressure atomizing spray gun according to claim 15, further comprising forwardly diverging conical guide walls at said intersection of said bottom of said air grooves with said inner periphery of said tip portion of said paint nozzle.

21. The low-pressure atomizing spray gun according to claim 15, wherein said air cap includes a cover.

22. The low-pressure atomizing spray gun according to claim 15, wherein said air grooves extend from at or upstream of said inlet end of said annular slit toward said discharge end of said tip portion of said nozzle.

* * * * *

(12) INTER PARTES REVIEW CERTIFICATE (33rd)
United States Patent
Kaneko

(10) Number: US 6,494,387 K1
(45) Certificate Issued: Oct. 15, 2014

(54) LOW-PRESSURE ATOMIZING SPRAY GUN

(75) Inventor: Masaru Kaneko

(73) Assignee: ANEST IWATA Corporation

Trial Number:

IPR2013-00111 filed Jan. 11, 2013

Petitioner: SATA GmbH & Co. KG

Patent Owner: ANEST IWATA Corporation

Inter Partes Review Certificate for:

Patent No.: 6,494,387
Issued: Dec. 17, 2002
Appl. No.: 09/763,729
Filed: Feb. 27, 2001

The results of IPR2013-00111 are reflected in this inter partes review certificate under 35 U.S.C. 318(b).

INTER PARTES REVIEW CERTIFICATE
U.S. Patent 6,494,387 K1
Trial No. IPR2013-00111
Certificate Issued Oct. 15, 2014

AS A RESULT OF THE INTER PARTES REVIEW PROCEEDING, IT HAS BEEN DETERMINED THAT:

Claims 1-14 are cancelled.

* * * * *